United States Patent [19]

Albertsen

[11] Patent Number: 4,770,158

[45] Date of Patent: Sep. 13, 1988

[54] COMBUSTION WITH LEAKAGE RESISTANT EXHAUST VALVE

[75] Inventor: Peter S. Albertsen, Warwick, R.I.

[73] Assignee: Nu-Tec Incorporated, East Greenwich, R.I.

[21] Appl. No.: 43,088

[22] Filed: Apr. 27, 1987

[51] Int. Cl.[4] ..... F24C 1/14

[52] U.S. Cl. ..... 126/80; 126/312; 126/316; 126/58; 110/163; 110/162; 110/147

[58] Field of Search ..... 126/58, 80, 77, 289, 126/290, 292, 293, 307 A, 312, 316; 98/34.6, 36, 79, 119; 236/61; 110/163, 162, 147, 203

[56] References Cited

U.S. PATENT DOCUMENTS

| | | | |
|---|---|---|---|
| 4,154,212 | 5/1979 | Wilkinson | 126/290 X |
| 4,385,620 | 5/1983 | Black | 126/290 X |
| 4,461,242 | 7/1984 | Black | 126/290 X |

FOREIGN PATENT DOCUMENTS 854299 11/1960 United Kingdom .

*Primary Examiner*—Larry Jones

[57] ABSTRACT

A combustor including a combustion chamber having two paths for removing combustion exhaust gases, a valve in one path, and means to provide, when the valve is in a closed position, pressure at a downstream side of the valve higher than the pressure inside the combustion chamber to prevent leakage of combustion gases from the combustion chamber through the valve.

8 Claims, 1 Drawing Sheet

COMBUSTION WITH LEAKAGE RESISTANT EXHAUST VALVE

FIELD OF THE INVENTION

The invention relates to combustors having alternate paths for removal of combustion exhaust gases, e.g., a wood burning stove having a catalytic converter in one path and a bypass valve in the other.

BACKGROUND OF THE INVENTION

Wood burning stoves have recently typically been provided with catalytic converters to remove creosotes to prevent them from coating insides of chimneys (fire hazards) and polluting the atmosphere. Bypass valves are typically used to bypass the catalytic converter during startup and refueling in order to prevent smoke spillage back into the house, caused by the flow resistance resulting from small openings and large surface area of the catalytic converter. Because of the flow resistance provided by the converter, if there is a leak in the bypass valve, there will be substantial flow of exhaust gases through it instead of the converter during operation.

SUMMARY OF THE INVENTION

It has been discovered that leakage flow from a combustion chamber past a closed exhaust valve can be easily prevented by providing a pressure on the downstream side of the valve that is higher than that in the combustion chamber. In preferred embodiments the combustor is a wood burning stove having a catalytic converter in one path for exhausting combustion gases and a bypass valve in another path; there is a second valve in series with the first valve, and air is provided to the space between the valves to provide the pressure; and the air is provided by a ¼" diameter feed tube to provide an air pressure that is only slightly above that in the combustion chamber.

Other features and advantages of the invention will be apparent from the following description of the preferred embodiment thereof and from the claims.

DESCRIPTION OF THE PREFERRED EMBODIMENT

Figure 1:
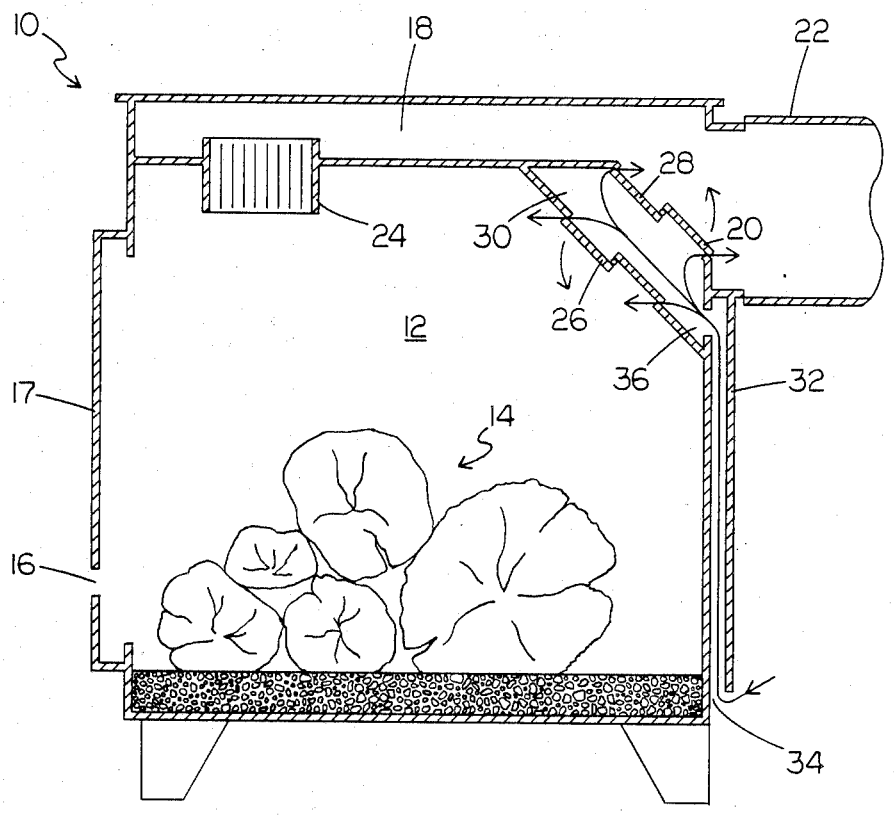

The preferred embodiment will now be described.

DRAWING

The drawing is a diagrammatic vertical section of a wood burning stove according to the invention.

STRUCTURE

Referring to the drawing, there is shown wood burning stove 10 having combustion chamber 12 for burning wood 14 therein. Stove 10 has primary air inlet 16 at its front in door 17, and two paths 18, 20 for exhausting combustion gas to flue 22. Path 18 includes catalytic converter 24. Path 20 includes rotatable bypass valves 26, 28, defining chamber 30 betweeen them. One-quarter inch diameter feed tube 32 has bypass bleed inlet 34 at one end and outlet 36 to chamber 30 at the other.

OPERATION

In operation, bypass valves 26, 28 are rotated counterclockwise to the open position during startup and refueling while door 17 is opened to prevent smoke spillage back into the house. During the remainder of use of stove 10, bypass valves 26, 28 are in the closed position as shown in the drawing. Leakage of gas is permitted past valves 26, 28, but gas flow is from chamber 30 to combustion chamber 12 and flue 22, owing to the introduction of air through tube 32. For example, the pressure in chamber 12 could be at $-0.03$ in. $H_2O$, and the pressure in flue 22 could be at $-0.05$ in. $H_2O$, owing to the pressure drop through converter 24. The pressure in chamber 30 is at $-0.01$ in. $H_2O$, owing to the restriction provided to atmospheric air entering inlet 34 by tube 32. Because the pressure in chamber 30 is higher than that in chamber 12 and flue 22, the flow past valves 26, 28 is from chamber 30 to them, and there is no leakage of exhaust gases in chamber 12 into flue 22, avoiding thus air pollution and creosote deposit on pipes. Tube 32 thus provides air pressure that is only slightly above that in the other chambers, keeping the introduction of air into them at a low level.

The use of valves 26, 28 and increased pressure prevents leaking without the use of fiberglass gaskets, which can deteriorate with use, or providing a seal by using tight tolerances, which seal could also be lost with distortion and warping of the metals with use.

OTHER EMBODIMENTS

Other embodiments of the invention are within the scope of the following claims.

What is claimed is:

1. A combustor comprising means defining a combustion chamber having two paths for removing combustion exhaust gases, a valve in one said path, and pressurizing means to provide, when said valve is in a closed position, pressure at a downstream side of said valve higher than the pressure inside said combustion chamber to prevent leakage of combustion gases from said chamber through said valve.

2. The combustor of claim 1 wherein said two paths meet at a common exhaust path, there is a second valve provided in series with the first valve in said one path, and air is provided to said path between said valves.

3. The combustor of claim 2 wherein a flow restriction is provided in the other said path.

4. The combustor of claim 2 wherein said air is provided to said path by a tube communicating with the atmosphere.

5. The combustor of claim 3 wherein said combustion chamber is adapted for burning wood, and said restriction is provided by a catalytic converter in said other path.

6. The combustor of claim 5 wherein said air is provided by a tube that communicates with the atmosphere and is sized to provide air pressure in said path between said valves that is only slightly above that in said combustion chamber.

7. The combustor of claim 6 wherein said feed tube has approximately a ¼" diameter.

8. The combustor of claim 7 wherein said tube is sized to provide a pressure of about $-0.01$ in. $H_2O$ between said valves.

* * * * *